United States Patent [19]

Rayfield

[11] 4,054,283

[45] Oct. 18, 1977

[54] FAN FOLD FORM STACKER

[75] Inventor: Harry F. Rayfield, Reseda, Calif.

[73] Assignee: Data Products Corporation, Woodland Hills, Calif.

[21] Appl. No.: 596,723

[22] Filed: July 17, 1975

[51] Int. Cl.[2] ..... B65H 45/20

[52] U.S. Cl. ..... 270/79

[58] Field of Search ..... 270/30–31, 270/61 F, 79; 197/133 F; 226/119, 14

[56] References Cited

U.S. PATENT DOCUMENTS

| | | | |
|---|---|---|---|
| 1,858,073 | 5/1932 | Cole | 270/79 |
| 3,464,610 | 9/1969 | Koning | 270/61 F |
| 3,790,156 | 2/1974 | Hogendyk | 270/79 X |
| 3,807,724 | 4/1974 | Bartz | 270/61 F |

OTHER PUBLICATIONS

IBM Technical Disclosure Bulletin (USA), vol. 14, No. 3, Aug. 1971.

*Primary Examiner*—Edgar S. Burr

*Assistant Examiner*—A. Heinz

*Attorney, Agent, or Firm*—Lindenberg, Freilich, Wasserman, Rosen & Fernandez

[57] ABSTRACT

Apparatus for stacking fan-folded paper including an oscillating chute through which paper received by the stacker from a printer passes toward a pedestal on which the paper is to be stacked. The stacker receives line strobe signals from the printer indicative of the rate at which paper is fed by the printer to the stacker. The line strobe signals control the rate of oscillation of the chute between two extreme positions. The distance between the two positions defines the oscillation stroke which is determined by means of a manually-operable selector to be a function of the form length of the paper to be stacked. The paper is stacked on a pedestal which is incrementally movable between top and bottom positions. A stack sensor is provided which senses the top of the stack and causes the pedestal to move toward the bottom position so as to maintain the distance between the chute and the top of the stack relatively constant.

24 Claims, 7 Drawing Figures

Fig. 1
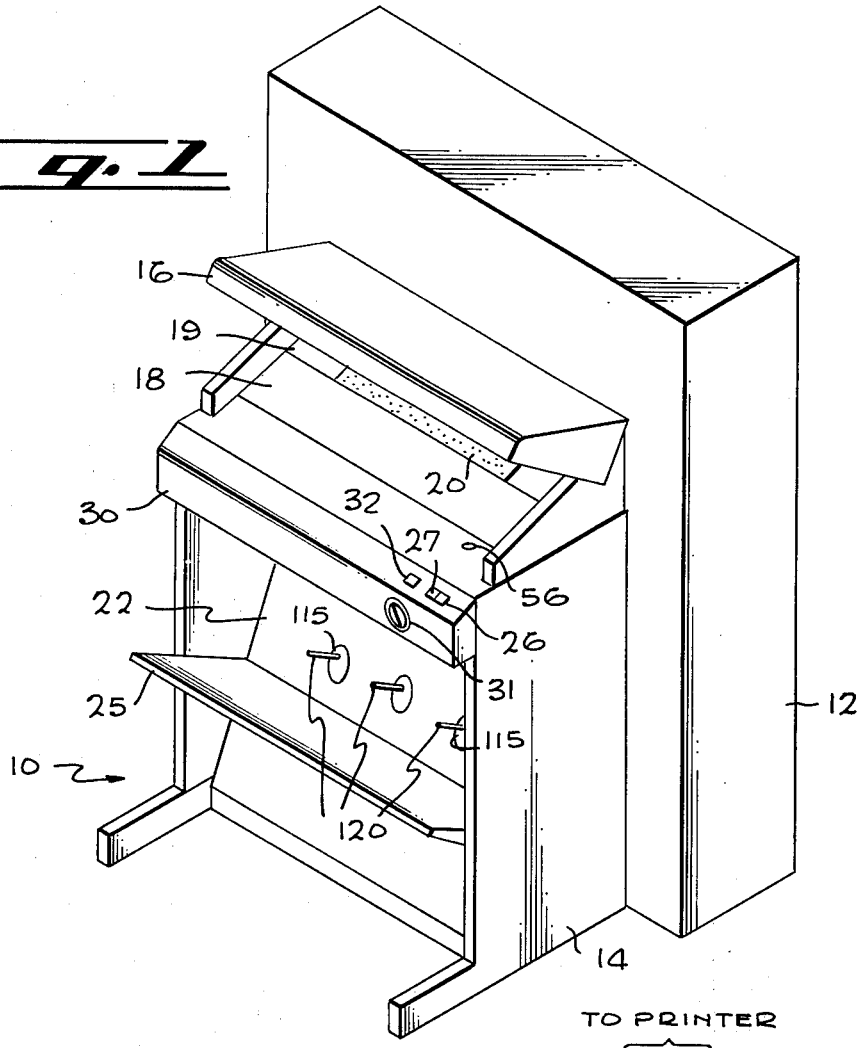
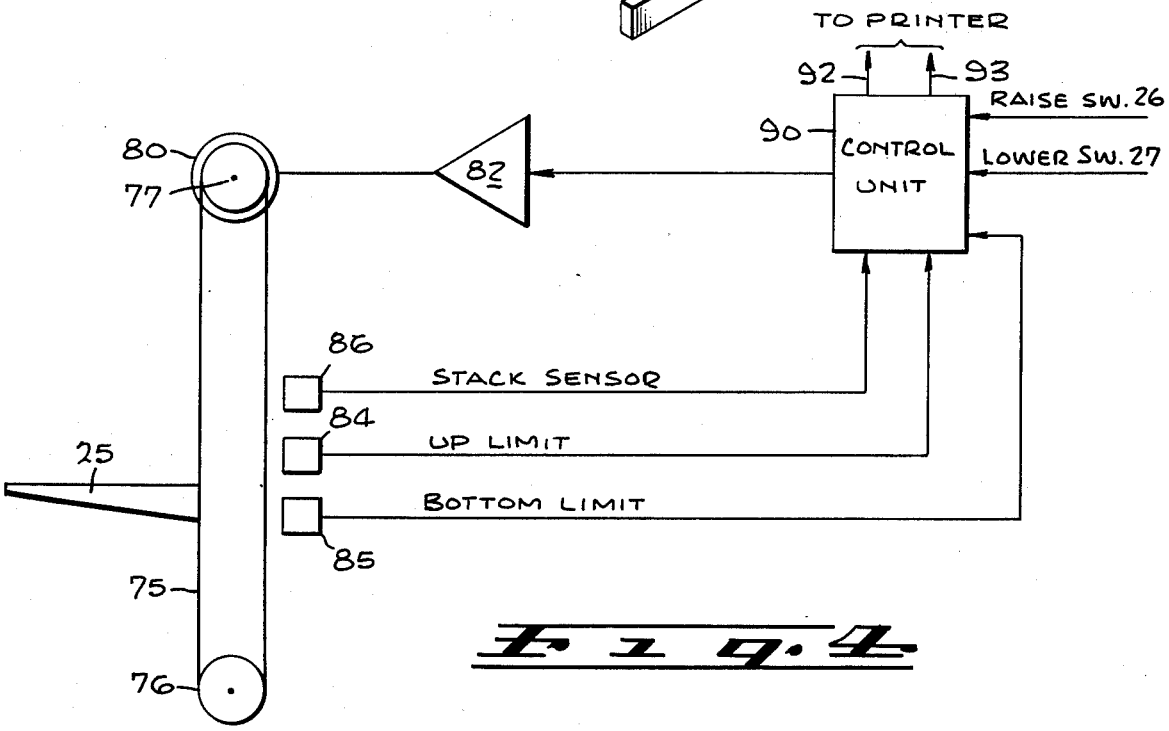
Fig. 4

FAN FOLD FORM STACKER

BACKGROUND OF THE INVENTION

The present invention generally relates to a system for stacking web material of the type that includes uniformly spaced and alternately directed folds extending across the width of the web and, more particularly, to apparatus for stacking fan-folded paper received from a high speed printer. Such printers find widespread use for printing computer output data.

SUMMARY OF THE INVENTION

A stacker in accordance with the present invention includes an oscillating chute through which paper received from a printer is directed. The stacker includes circuitry which controls the chute to oscillate between two extreme positions, at a rate which is a function of the rate at which paper is fed to the stacker. The distance between the two extreme positions, defined as the oscillation stroke is defined by operator controls dependent on the form length of the paper to be stacked.

In accordance with a further aspect of the present invention, the paper exiting the chute is stacked on a platform which is incrementally lowered, so as to maintain the distance between the top of the stack and the outlet end of the chute relatively constant. When the platform is lowered to a selected position, a signal is supplied from the stacker to interrupt the printer operation. After removing the paper stack from the platform, the operator returns the platform to a selected uppermost position supplying a signal to the printer to indicate that the stacker is in condition to receive additional paper.

The novel features of the invention are set forth with particularity in the appended claims. The invention will best be understood from the following description when read in conjunction with the accompanying drawings.

BRIEF DESCRIPTION OF THE DRAWINGS

FIG. 1 is a perspective view of the stacker and a printer;

FIGS. 4 and 5 are diagrams useful in explaining the manner in which pedestal position is controlled;

DESCRIPTION OF THE PREFERRED EMBODIMENTS

Figure 2:
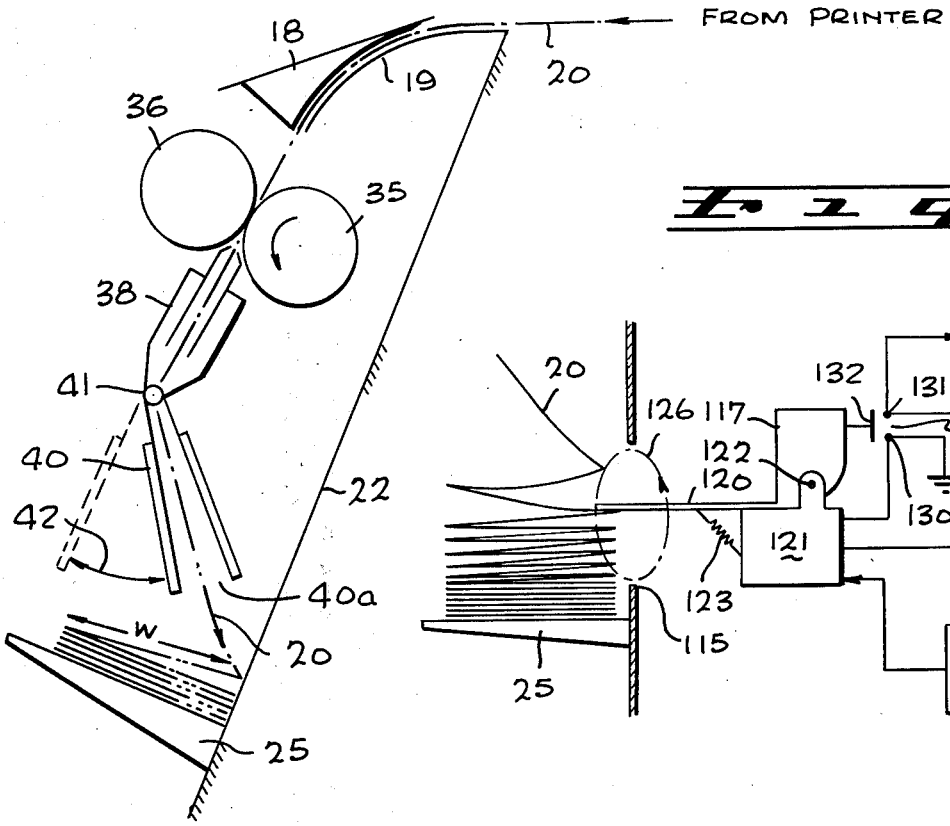
FIG. 2 is a simplified diagram useful in explaining the path of the paper through the stacker.

The stacker will be described in connection with a printer which serves as the source of the fan-folded paper to be stacked. However, as will be appreciated it is not intended to be limited thereto, and may be used with other devices from which fan-folded webs exist. In FIG. 1 the stacker is designated by numeral 10 and the printer by numeral 12. The stacker comprises a housing 14 having a hingeable top cover 16, which is shown in a raised position. The paper to be folded, which exits the printer 12, enters through the back side of the stacker 10 and is guided therein between an upper guide 18 and a lower guide 19. The paper path through the stacker is shown in FIG. 2. The paper is designated by numeral 20 and in FIG. 2 part of it is shown by a dashed line. The stacker includes a stationary inclined stack support panel 22 and a movable pedestal or platform 25 which is raised and lowered, as will be described hereinafter, by the actuation of a Raise switch 26 and a Lower switch 27 on a control panel 30 of the stacker. The control panel 30 also includes a form length selector 31 and a form length indicator 32.

As shown in FIG. 2 the paper 20 from the printer 12 is guided by guides 18 and 19 to pass between a motor driven drive roller 35 and a tension roller 36. The drive roller 35, which for the arrangement shown in FIG. 2 is assumed to rotate counterclockwise, pulls the paper toward a stationary guide 38. The paper, passing through guide 38, enters a chute 40 which is pivotally mounted about a pivot point 41. Paper exits the chute 40 through outlet end **40*a* toward the pedestal 25.**

As will be described hereinafter in detail, the stacker includes a chute motor which causes the chute 40 to pivot about point 41 so that its outlet end **40*a* oscillates back and forth, as represented by arrow 42, between two extreme positions (oscillation stroke) as paper is fed through the chute toward the pedestal. The rate of chute oscillation is directly related to the speed or rate at which paper is fed to the stacker by the printer. The rate of paper feed is indicated by line strobe pulses, hereinafter simply referred to as line strobes, supplied by the printer 12.** One line strobe is provided for each line printed by the printer. Assuming that the printer prints 6 lines per inch, 6 line strokes are supplied to the stacker as each inch of paper is fed to the stacker.

As will become clear from the following description one extreme position, hereinafter referred to as the first or zero position, is the same regardless of the form length. In the zero position, the chute's outlet end **40*a* effectively points toward the panel 22. In the other or second extreme position (not shown) the outlet end points in a direction away from panel 22. The second position is selected by the operator by means of the form length selector 31. Basically, the selector 31 is a multiposition switch, with one position for each possible form length. In one embodiment the selector 31 includes 17 positions for paper with any of the following form lengths in inches: 3 ½, 3 ⅔, 5 ½, 6, 6 ½, 7, 7 ⅓, 8, 8 ½, 9, 10, 11, 12, 13, 14, 15 and 17. The operator sets the selector 31 to the position corresponding to the form length of the paper to be stacked. The selected position in terms of form length is indicated by indicator 32. As will be explained hereinafter the setting of selector 31** in effect controls the second position of the chute and thereby controls the oscillation stroke. Thus, while the oscillation rate is a function of paper feed rate, the oscillation stroke is chosen by the operator, to depend on the form length of the paper to be stacked.

For the stacker to operate properly it is important that the distance between the chute's outlet end **40*a* and the empty pedestal level or the top of the stack of paper on the pedestal be held relatively constant, to within about one inch. This is achieved by raising the pedestal to a top position before stacking starts. A stack height sensor is provided which effectively senses the top of the stack. As the stack height builds up during the stacking operation, the pedestal is stepped down so as to maintain the distance between the chute's outlet end and the stack top substantially constant. When the pedestal reaches a selected lower position, a bottom limit switch is activated to send a command to the printer to stop the feeding of paper. Then, the operator removes the stack of paper which was built up on the pedestal. Thereafter he returns the pedestal by activating Raise switch 26 (FIG. 1**) to the top position, and the stacker is ready to resume its normal paper stacking operation. When the pedestal is at the top position an up limit switch is activated. It sends a signal to the printer to indicate that the pedestal is at the top position and that paper can be fed thereto.

Figure 3:
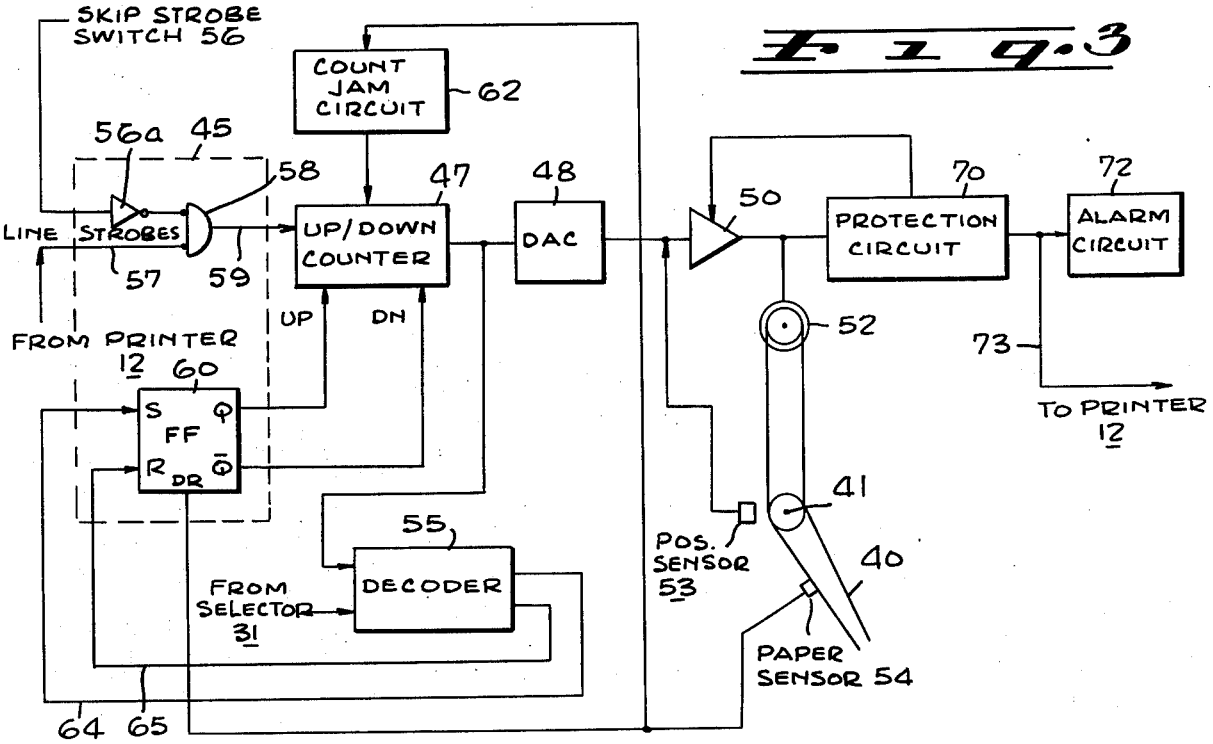
FIG. 3 is a block diagram of circuitry of the stacker for controlling chute oscillation and oscillation stroke.

Circuitry in the stacker for controlling the rate of oscillation and the oscillation stroke of the chute 40 is diagrammed in FIG. 3. This circuitry is presented for explanatory purposes only and it will be readily recognized that alternative circuit arrangements can be used. The circuitry is shown to include a control unit 45, an Up-Down counter 47, a digital-to-analog converter (DAC) 48, a servo amplifier 50, a chute motor 52, a position sensor 53, a paper sensor 54, and a decoder 55.

Briefly, the function of the control unit 45 is to supply pulses to be counted by counter 47 in a direction, either up or down controlled by the control unit 45. The count in the counter 47 is converted to an analog signal by a digital-to-analog converter (DAC) 48, whose output is supplied to the servo amplifier 50, which is also supplied with a feedback signal from position sensor 53. The output of the amplifier 50 is used to drive the chute servo motor 52 which rotates the chute 40 about pivot point 41. The position of the chute in its oscillatory cycle is directly related to the analog output of DAC 48. The decoder 55 decodes the count in the counter 47. As paper is fed through the chute 40, whenever the count in counter 47 reaches zero the decoder 55 activates the control unit 45 to switch the counter to count Up. On the other hand, whenever the count in counter 47 reaches a desired count, which depends on the setting of the form length selector 31 the decoder activates the counter to count Down.

The operation of the circuitry may best be explained with a specific example, in which the form length of the paper to be folded is assumed to be 11 inches long. The operator sets the selector 31 for 11 inch form length paper. It is also assumed that the print rate is 6 lines per inch. Thus, as each form is fed to the stacker 66 line strobes are supplied to the stacker by the printer via line 57, 6 line strobes per inch. As shown in FIG. 3, line 57 is connected to one input of a Nand gate 58 in unit 45. The other input to gate 58 is from a skip strobe switch 56 through an inverter 56*a*. For explanatory purposes at this point the function of switch 56 can be ignored and it is sufficient to assume that as each line strobe is received on line 57 gate 58 supplies a pulse on line 59 which is counted by counter 47.

As shown in FIG. 3, the control unit 45 includes a direction flip flop (FF) 60, which controls the counter to count Up when FF 60 is set and to count Down when FF 60 is reset. The state of FF 60 is controlled by outputs from decoder 55. The FF 60 is also assumed to include a direct reset (DR) input which when activated by paper sensor 54 automatically drives FF 60 to its reset state. Before stacking starts, it is desirable to position the chute near the zero position which depends on the distance between the chute outlet 40a and the unloaded pedestal. In order to establish this initial position, a count jam circuit 62 is provided which is activated by paper sensor 54 to jam a starting count (e.g. eight) into the counter 47.

In operation, as paper is initially fed into the stacker, even though line strobes are received, as long as paper is not sensed by sensor 54, the count in counter 47 remains jammed at the count of eight. FF 60 is directly reset for a Down count condition. As paper reaches the chute 40 and is sensed by paper sensor 54, the jam condition is removed and the direct reset of FF 60 is removed. Since the latter is in the reset state, the pulses on line 59, corresponding to the received line strobes, cause the counter to count down from eight toward zero. As the count in the counter decreases, the output of DAC 48 decreases thereby driving the motor 52 via amplifier 50 to rotate the chute toward its zero position. When the count in the counter is zero the chute is in the zero position. Also, when the count in the counter 47 is zero the decoder 55 provides an output via line 64 to set FF 60 and thereby control the counter to count Up.

The subsequently received line strobes on line 57 increment the count in the counter 47 from zero. As the count therein increases, the analog output of DAC 48 increases, thereby causing the amplifier 50 to drive the motor 52 so as to rotate the chute from the zero position toward the second position. Thus, it should be clear that the rate of rotation or oscillation of the chute 40 is directly related to the rate at which line strobes are received from the printer 12, which is in turn related to the rate at which paper is fed out of the printer to the stacker.

The decoder 55 in addition to providing the output on line 64 to set FF 60, when the count in the counter is zero, also decodes all other counts in the counter. However, based on the setting of selector 31 it provides an output on line 65 to reset FF 60 only when a particular count in the counter is decoded.

For example when selector 31 is set for 11 inch form length and assuming 6 line strobes per inch the decoder 55 upon decoding a count of 66 resets FF 60 thereby switching the counter 47 to count Down. Thus, the maximum count in the counter for 11 inch form length is 66, at which time the DAC analog output corresponds to the count of 66 and the chute is at the second position. After the counter is switched to count Down, subsequent pulses decrement the count in the counter toward zero. As a result the DAC output decreases thereby driving the chute toward the zero position which is reached when the count in the counter reaches zero once more. Thus, in the particular example the chute oscillates from the first to the second position as the count increases from zero to 66 and oscillates back toward the zero position as the count decreases from 66 to zero.

On the other hand when selector 31 is set for 5 ½ inch form length the decoder resets FF 60 when a count of $5\frac{1}{2} \times 6 = 33$ is decoded, which represents the maximum count for 5 ½ inch form length. It should thus be apparent that with such a selector setting, the oscillator stroke is half of the one when 11 inch form length paper is stacked. It should thus be apparent that the oscillation stroke depends on the setting of selector 31, which is set by the operator, depending on the form length of the paper to be stacked. Alternately stated the oscillation stroke is related to the form length.

In one embodiment which was actually reduced to practice the circuitry was simplified by limiting the output of the DAC not to exceed an output corresponding to a count of 64 (which is a power of 2) even when the count in the counter is greater than 64. Thus, in the particular embodiment for 11 inch form length the chute reaches the second position when the count in the counter reaches 64 and it remains in the second position as the count increases to 65 and then to 66. Upon reaching the count of 66 the decoder resets FF 60 to count Down. The chute remains however in the second position as the count is decremented to 65 and thereafter to 64. Only after the count is decremented to 63 and below does the DAC output decrease and is directly related to the count in the counter. Thus, in the particular embodiment for 11 inch form length the chute oscillates between the two positions as the count varies between 0 and 64 and remains in the second position when the count in the counter is incremented to 65 and then to 66 and thereafter is decremented to 65 and 64. Limiting the DAC output not to exceed an output corresponding to a count of 64 may be achieved by incorporating gating circuitry between the counter 47 and the DAC or by clipping the DAC output not to exceed an output corresponding to a count of 64.

In order to handle form lengths longer than 11 inch, the stacker nevertheless can operate satisfactorily even though the oscillation stroke is the same as for 11 inch form length. Thus, in the particular embodiment reduced to practice the decoder provides an output on line 65 to reset FF 60 upon decoding a count of 66 where $f \geqq 11$. However, the second position of the chute is reached when the count is 64 and remains thereat until the count falls below 63. For example for 12 inch form length the decoder resets FF 60 when the count of $6 \times 12 = 72$ is reached. However, the second position is reached when the count in the couter is 64 and remains thereat until the count drops again below 64.

Similarly, when the selector 31 is set for 17 inch paper the decoder resets FF 60 when the count in the counter reaches $6 \times 17 = 102$. However, the maximum output of DAC 48 is that corresponding to a count of 64 when the chute reaches the second position. It remains thereat while the count first increments from 64 to 102 and thereafter decreases from 102 to 64. Only when the count is decremented to 63 and below does the chute move from the second position to the first position which is reached when the count in the counter is again zero.

It has also been found that when stacking paper with very short form length such as 3 ½ or 3 ⅔ inch, the stack height tends to build up quite rapidly and frequent removal of the built up stack is required. Also, if the oscillation stroke is directly related to the short form length the stack width is narrow, equal to the form length, making handling of a narrow and high stack quite different. In order to overcome these disadvantages, and since 3 ⅔ is exactly one third of 11, in one particular embodiment whenever the selector 31 is set for 3 ⅔ inch form length the decoder operates as if 11 inch form length is to be stacked, thus providing an oscillation stroke corresponding to 11 inch form length. For 3 ½ inch form length the stacker operates as though a 10 ½ inch form is being stacked. In such an embodiment stacking of the shorter form lengths is very adequate, except that each stack layer consists of three forms rather than a single form. When stacking paper with 3 ⅔ inch form length the stack width is $3\frac{2}{3} \times 3 = 11$ inch while when stacking paper with 3 ½ inch form length the stack width is $3\frac{1}{2} \times 3 = 10\frac{1}{2}$ inch.

It is thus seen that in the stacker of the present invention, the rate of chute oscillation is a direct function of the rate at which line strobes are supplied by the printer to the stacker which corresponds to the rate at which paper is fed to the stacker. However, the oscillation stroke, i.e., the distance between the two extreme positions between which the chute oscillates, depends on the manual setting or position of selector 31, which is chosen by the operator, and is dependent on the form length of the paper to be folded. The zero position of the chute is preferably the same regardless of form length. The chute is in the zero position whenever the count in the counter 47 is zero and the DAC output is also zero.

In order to protect the drive motor 52 from excessive over current or voltage from servo amplifier 50 a protection circuit 70 is included. Whenever the amplifier output voltage or current exceeds a selected threshold level for a selected period, e.g. 0.9 second the protection circuit 70 is activated. When activated it disables the amplifier 50. It also activates an alarm unit 72. Furthermore, it sends signals via line 73 to the printer 12 in which a Stacker Service indicator is illuminated and the printer is taken OFF LINE, thereby stopping the paper feeding. After the over current (or voltage) is removed a Master Clear button on the printer is used to reset the protection circuit 70. The resetting signal from the printer is supplied to circuit 70 via line **73*a*. When the circuit 70 is reset, it reactivates the amplifier 50** in the stacker. Then a Start button in the printer is activated to switch the printer to ON LINE to resume paper feeding to the stacker.

For proper stacking to occur, the paper which exits the chute has to be synchronized, i.e. in sync with the chute position. From FIG. 2 it should be appreciated that when the chute is in the zero position the fold in the paper should be in a direction so as to urge the paper to fold and be stacked on the top form on the stack. If for some reason the paper is out of sync with the chute position, such as due to improper initial loading of the paper in the printer, means need be provided to establish sync between the paper and the chute. This is achieved by means of the skip strobe switch 56 (see FIGS. 1 and 3). As long as switch 56 is not activated the input to inverter **56*a* is High and its output is Low. Thus, the line strobes on line 57 activate gate 58 to apply pulses on line 59 to counter 47. However, when an out of sync condition occurs, the operator presses switch 56, thereby applying a Low output to inverter 56a whose output goes High. Thus, gate 58 is deactivated and does not respond to the line strobes. Consequently, the count in the counter does not change and the chute remains in a stationary position. The switch 56** is depressed by the operator until sync is re-established between the chute and the paper, at which time the switch is deactivated and normal stacking ensues. During sync re-establishment the operator may have to direct several of the forms to be properly folded on the stack.

As previously pointed out, for the stacker to operate properly it is necessary to maintain the distance between the chute outlet end and the top of the stack, which is being built up on the pedestal 25, relatively constant. This is achieved by controlling the pedestal so that it moves down as paper is being stacked. The manner in which this is accomplished may best be explained in connection with FIGS. 4 and 5.

In FIG. 4, numeral 75 designates a chain to which the pedestal 25 is coupled. The chain is supported between an idle gear 76 and a gear 77 which is driven by a bidirectional motor 80, which is controlled by the output of a servo amplifier 82. Also included are several switches. These include an up limit switch 84 which is activated when the pedestal 25 reaches an upper limit or top position, and a bottom limit switch 85 which is activated when the pedestal reaches a lower limit or bottom position. Also included is a stack sensor 86 which effectively senses the top of the stack which is being built up on the pedestal as stacking takes place. When activated it causes the pedestal to be lowered so as to maintain the distance between the stack top and the chute outlet end relatively constant. The outputs of 84–86 and the Raise and Lower switches 26 and 27 (see FIG. 1) are connected to a control unit 90 which controls the servo amplifier 82.

In operation, before stacking starts, the pedestal is raised to its top position by depressing Raise switch 26. When reaching the top position, up limit switch 84 is activated. As a result, unit 90 sends a signal via line 92 to the printer to indicate that stacking can start. The operator places the printer ON LINE by activating the Start switch on the printer which then feeds paper to the stacker. The stack sensor 86 senses the stack which is being built up in the pedestal, and when activated causes the pedestal to be lowered so that despite the stack height, its top is at the desired distance from the chute outlet end.

When the pedestal is lowered and reaches its bottom position, bottom limit switch 85 is activated. When activated, the control unit 90 sends a signal view line 93 to the printer in which the Stack Service light is illuminated and the printer is switched OFF LINE. The operator removes the stack of paper from the pedestal and thereafter presses Raise switch 26. The control unit 90 causes the pedestal to rise automatically to the top position. When reached, the up limit switch 84 is again activated and unit 90 informs the printer via line 92 that the stacker is ready to resume stacking. Paper feeding is restarted when the operator returns the printer ON LINE by pressing the printer's Start switch. The Lower switch 27 is used to lower the pedestal to any desired position between its top and bottom positions.

Figure 5:
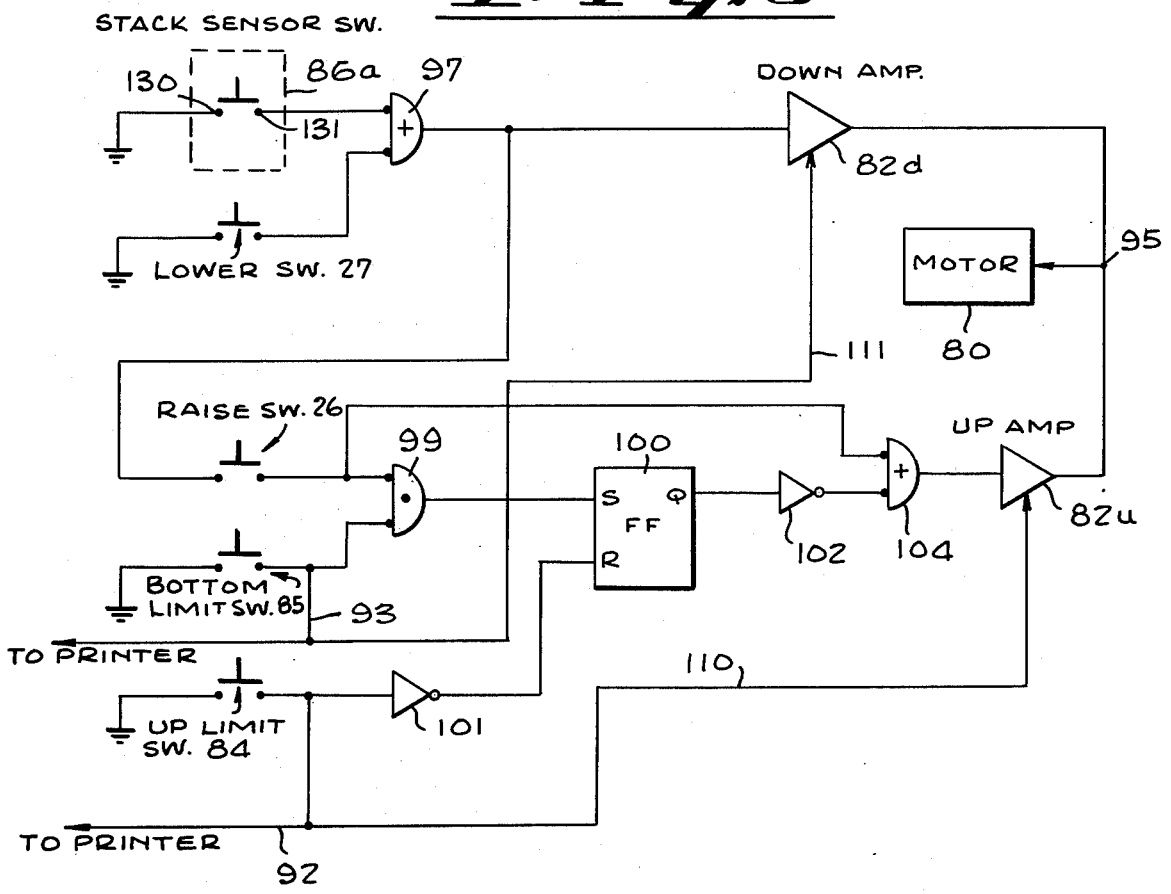

FIG. 5 illustrates a simplified diagram of the control unit 90, amplifier 82 and motor 80. The arrangement shown in FIG. 5 is presented to describe a simplified arrangement to perform the operations, hereinbefore described, rather than to limit the invention thereto. The servo amplifier 82 is represented in FIG. 5 by an Up amplifier **82*u* and a Down amplifier 82*d*. The outputs of the two amplifiers are connected together at a junction point 95 which is connected to motor 80. To facilitate the description of FIG. 5** the following assumptions are made. A Low output (or input) is assumed to be an output (or input) at ground level, or simply ground, a High output (or input) is an output (or input) above ground, while a Negative output (or input) is an output (or input) below ground.

Each of amplifiers **82*u* and 82*d* is activated by a High input. The former when activated applies a High output to point 95, while the latter when activated provides a Negative output at point 95. At any time only one of the amplifiers can be activated. When deactivated its output is Low. When junction point 95 is Low the motor 80 is deactivated and therefore maintains the pedestal at a stationary state. When junction point 95 is High, motor 80 rotates in one direction to raise the pedestal, while rotating in the opposite direction to lower the pedestal when point 95** is Negative.

The input to amplifier **82*d* is the output of a Nor gate 97 whose two inputs are connected to the Lower switch 27 and a switch 86*a* which is part of the stack sensor 86. The output of gate 97 goes High to activate amplifier 82*d*, and thereby causes the pedestal to be lowered, when either the Lower switch 27 or the stack sensor's switch 86*a* is activated. However, when neither of these switches is activated the output of gate 97 is Low and amplifier 82*d*** is not activated.

The output of gate 97 is also connected through Raise switch 26 to one input of a Nand gate 99, whose output is connected to the set (S) input of a flip flop (FF) 100. The other input of gate 99 is from the bottom limit switch 85. The up limit switch 84 is connected to the reset (R) input of FF 100 through an inverter 101. The Q output of FF 100 is connected through another inverter 102 to one input of a Nor gate 104, whose output serves as the input to amplifier **82*u*. The other input to gate 104 is from the Raise switch 26.**

In operation, when the pedestal is at the bottom position, one input of gate 99 is Low through bottom limit switch 85. With the output of gate 97 being Low when Raise switch 26 is depressed momentarily both inputs to gate 99 are Low. Therefore, the output of gate 99 goes High, thereby setting FF 100 so that its Q output goes High and the output of inverter 102 goes Low. Consequently, the output of gate 104 goes High, thereby activating amplifier **82*u*, which in turn drives motor 80 to raise the pedestal. When the pedestal reaches the top position up limit switch 84 is activated. Consequently, the output of inverter 101 goes High, resetting FF 100. Therefore the Q output goes Low and the output of 102 goes High to deactivate gate 104, whose output goes Low, thereby deactivating amplifier 82*u*.**

As shown in FIG. 5 the up limit switch 84 is connected to amplifier **82*u* via line 110. Once the up limit switch 84 is activated it disables the amplifier 82*u*, so as to prevent the pedestal from rising above the top position even if Raise switch 26 is activated. Also as shown in FIG. 5 the bottom limit switch 85 is connected to the printer via line 93. When switch 85 is activated, which occurs when the pedestal is at the bottom position, the printer, in response to the Low level on line 93 goes OFF LINE and the Stack Service indicator on the printer is illuminated. When the switch 85 is deactivated, such as when the pedestal rises above the bottom position, the Stack Service indicator may be extinguished. However, the printer remains OFF LINE until the up limit switch 84 is activated, providing a Low on line 92. Only then can the printer be returned to ON LINE by depressing its Start switch. As shown in FIG. 5 the bottom limit switch 85 is connected to the Down amplifier 82*d* via line 111. When switch 85 is activated, which occurs when the pedestal is at the bottom position, amplifier 82*d*** is deactivated to prevent it from lowering the pedestal below the bottom position.

Figure 6:
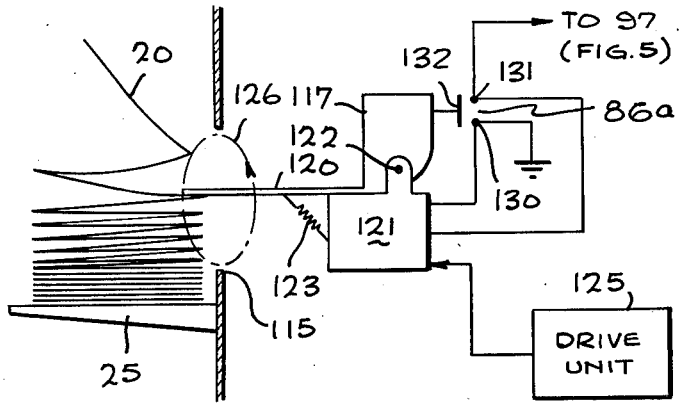
FIG. 6 is a diagram of a novel sensor for sensing the top of a stack of folded paper.

Attention is now directed to FIGS. 1 and 6 in connection with which a specific embodiment of the stack sensor 86 will be described. As shown in these two figures several oval-shaped openings 115 are formed in the stack support panel 22. The stack sensor comprises an elongated plate 117 from which a plurality of fingers 120 extend. The plate 117 is shown resting on a support unit 121. The plate 117 is capable of pivoting upwardly with respect to unit 121 about pivot point 122. The plate is spring biased by a spring 123 toward the unit 121 on which it rests. A drive unit 125 drives the support unit 121 and the plate 117 with its fingers 120 in an oval-shaped pattern as represented by 126 in FIG. 6. This drive pattern is achieved in one embodiment by eccentrically mounting the support unit 121 on a rotatable shaft in drive unit 125. Except for the front portions of the fingers 120 the rest of the arrangement is always behind the panel 22. The front portions of fingers 120 protrude through the opening 115 while moving downwardly during one half of the motion cycle. During the other cycle half the fingers' front portions are behind the panel 22 and they move upwardly. The openings 115 are located above the top position of the pedestal so that it never comes in contact with the protruding downwardly moving fingers.

In FIG. 6, two spaced apart contracts or terminals 130 and 131 are shown. They are assumed to be supported by support unit 121. Terminal 130 is grounded while terminal 131 is connected to Nor gate 97 (see FIG. 5). Spaced from the two terminals is a contact plate 132 which is connected to the plate 117. As long as the plate 117 rests on unit 121 (as shown) contact plate 132 is spaced apart from terminals 130 and 131 and therefore the latter remains ungrounded. Terminals 130 and 131 and contact plate 132 represent the switch **86*a* of the stack sensor 86.**

As paper is being stacked on the pedestal 25 the height of the stack above the pedestal increases and eventually reaches a point in which the downwardly moving fingers come in contact with the stacked forms, which apply an upward force to the fingers. As long as the stack height is small the forms are loosely packed and therefore the upward force is insufficient to overcome the bias force, provided by spring 123. Thus, the plate 117 remains resting on the support unit 121 and switch **86*a* is deactivated. However, as more forms are stacked, due to the weight of the forms the stack density increases, and therefore the upward force, applied by the stacked forms, increases. When it exceeds the biasing force of the spring 123, as the fingers move downwardly, the upward force, applied to the fingers 120, causes the plate to pivot upwardly about point 122, and therefore at some point contact plate 132 comes in contact with terminals 130 and 131 thereby grounding the latter through terminal 130.**

Figure 7:
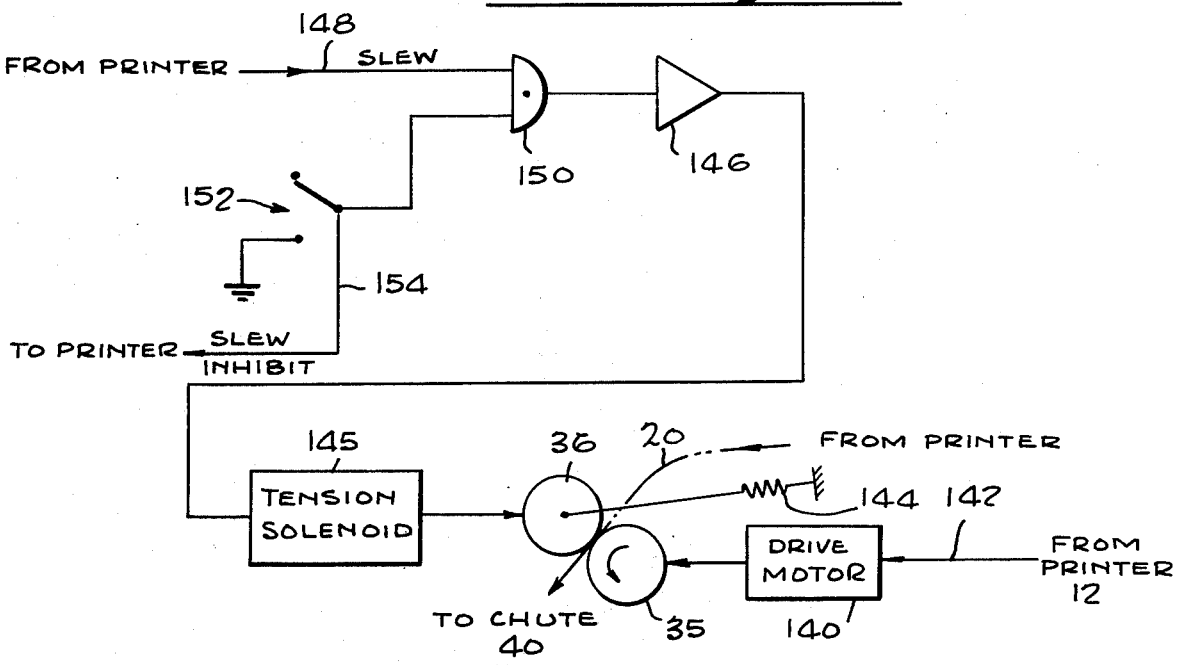
FIG. 7 is a simple diagram of circuitry designed to control another feature of the stacker.

As previously pointed out in connection with FIG. 2 the paper 20 which is fed from the printer 12 is pulled to the chute 40 through a driver roller 35 and a tension roller 36. The rollers are also shown in FIG. 7. In accordance with the present invention the driver roller 35 is driven by a drive motor 140 at a constant speed as long as a Drive signal is received from the printer on line 142. The Drive signal is assumed to be present when line 142 is High. In order to reduce wear between the rollers 35 and 36, when paper feeding from the printer ceases for any selected period the Drive signal is terminated and line 142 goes Low. Consequently, motor 140 is turned off.

With a constant rate of rotation of drive roller 35, the pull on the paper is related to the tension to which the roller 36 is directed toward roller 35. The pull is controlled by a tension spring 144. Under normal printing conditions the tension is such that the paper is pulled through the rollers at low tension as it is fed from the printer. For example, at a print rate of 1600 lines per minute, with 6 lines per inch the tension is chosen so that with the constant rate of rotation of drive roller 35 the paper is pulled at the rate of 1600/6 inches per minute. Most modern printers are also operable in a Slew mode, in which the rate of paper feed from the printer changes rapidly. In order to accommodate the rapid paper acceleration the tension on roller 36 has to increase. Tension solenoid 145 provides an increase in tension to accelerate the paper to slew speed.

When the printer is in the Slew mode, it supplies a slew signal (High) to the stacker on line 148, which is connected as one input to an And gate 150. The stacker includes a manually operated two-position switch 152, whose moving arm is connected to the other input of gate 150, whose output is connected to amplifier 146.

In the switch position as shown, the input for gate 150 from switch 152 is ungrounded and therefore is High. Consequently, when the printer is in the Slew mode, line 148 is High, resulting in a High input to amplifier 146 from gate 150. When the input to amplifier 146 is High, the tension solenoid 145 increases the tension on roller 36. The operator may disable the printer's Slew mode by switching the switch 152, so that its movable arm is grounded. Connected to the movable arm is a line 154 which is connected to the printer. When line 154 is grounded it represents a Slew Inhibit signal to the printer, thereby preventing it from operating in the Slew mode. When the moving arm is grounded the input to gate 150 from the switch 152 is Low and therefore the output of gate 150 is Low. As a result, the amplifier 146 activates the solenoids 145 to apply normal tension to tension roller 36.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed is defined as follows:

1. For use with a device from which paper, fan-folded along equally spaced folds in the paper is supplied, the distance between successive folds defining a form length, the device providing a sequence of discrete electrical signals, each signal representing a certain length of paper supplied by said device, the rate of such signals representing the speed at which paper is supplied by said device, an apparatus for stacking the fan-folded paper supplied thereto from said device, the apparatus comprising:

a paper reception station including a movable base member on which fan-folded paper is to be stacked;

a chute having an outlet and disposed above said base member;

input means for receiving fan-folded paper supplied thereto from said device and for directing the received paper through said chute toward said base member, the paper exiting said chute through the outlet end thereof; and control means including means connected to said device and responsive to the electrical signals provided by said device for controlling said chute outlet end to oscillate between first and second positions at a rate related to the rate at which said electrical signals are provided by said device, the distance between said first and second positions defining an oscillation stroke.

2. The apparatus as recited in claim 1 wherein said control means further include means for controlling the oscillation stroke based upon the form length of the paper which is being stacked.

3. The apparatus as recited in claim 2 wherein the means for controlling the oscillation stroke include a manually-operable multiposition switch with the oscillation stroke being dependent on the switch position.

4. The apparatus as recited in claim 2 wherein said first position is independent of the form length with said means for controlling the oscillation stroke comprise means for controlling the second position of said chute outlet end to be a function of the form length of the paper which is being stacked.

5. The apparatus as recited in claim 4 wherein the means for controlling the second position of said chute outlet end include a manually operable multiposition switch, with the second position of said chute outlet end being dependent on the switch position.

6. The apparatus as recited in claim 1 wherein said control means include means for moving said base member between a top position in which said base member is closest to said chute outlet end and a bottom position in which said base member is at a preselected distance from said chute outlet end, said control means further including means for sensing the paper being stacked on said base member and for activating said means for moving said base member to move the latter toward said bottom position so as to maintain the top of the stack of paper on said base member at a relatively constant distance from said chute outlet end.

7. The apparatus as recited in claim 6 wherein said apparatus further includes a first switch which is activated when said base member is at said bottom position and a second switch which is activated when said base member is at said top position.

8. The apparatus as recited in claim 7 wherein said apparatus further includes means for applying a first signal to said device when said first switch is activated, said device being responsive to said first signal to terminate the supply of paper to said apparatus, said apparatus further including means for applying a second signal to said device when said second switch is activated to indicate to said device that said base member is at said top position.

9. The apparatus as recited in claim 6 wherein said control means further include means for controlling the oscillation stroke based upon the form length of the paper which is being stacked.

10. The apparatus as recited in claim 9 wherein the means for controlling the oscillation stroke include a manually-operable multiposition switch with the oscillation stroke being dependent on the switch position.

11. The apparatus as recited in claim 9 wherein said first position is independent of the form length with said means for controlling the oscillation stroke comprise means for controlling the second position of said chute outlet end to be a function of the form length of the paper which is being stacked.

12. The apparatus as recited in claim 11 wherein the means for controlling the second position of said chute outlet end include a manually operable multiposition switch, with the operation of said means for controlling being dependent on the switch position.

13. The apparatus as recited in claim 12 wherein said apparatus further includes a first switch which is activated when said base member is at said bottom position and a second switch which is activated when said base member is at said top position.

14. The apparatus as recited in claim 13 wherein said apparatus further includes means for applying a first signal to said device when said first switch is activated, said device being responsive to said first signal to terminate the supply of paper to said apparatus, said apparatus further including means for applying a second signal to said device when said second switch is activated to indicate to said device that said base member is at said top position.

15. The apparatus as recited in claim 1 wherein said control means include an up-down counter, means for applying said electrical signals to said counter for varying the count therein, counter control means including a count decoder responsive to the count in said counter for controlling said counter to increment the count therein by one in response to each electrical signal applied thereto, when the count in said counter is a preselected first count, and for controlling said counter to decrement the count therein by one in response to each electrical signal applied thereto when the count in said counter is a preselected second count, and means responsive to the count in the counter for driving said chute so that its outlet end is at said first position when said first count is in said counter and for driving said chute so that its outlet end moves toward said second position from said first position at the rate at which the count in the counter is incremented from said first count.

16. The apparatus as recited in claim 15 wherein said counter control means include manually operable means for controlling the selection of said second count.

17. The apparatus as recited in claim 16 wherein said manually operable means is a multiposition switch with the selection of the second count being dependent on the position of said switch.

18. The apparatus as recited in claim 17 wherein said first count is zero and the means responsive to the count include means for converting the count in said counter between zero up to a selected third count which is not greater than said second count into an analog signal, and drive means for controlling the chute's outlet end position as a function of said analog signal.

19. The apparatus as recited in claim 18 wherein said control means include means for moving said base member between a top position in which said base member is closest to said chute outlet end and a bottom position in which said base member is at a preselected distance from said chute outlet end, said control means further including means for sensing the paper being stacked on said base member and for activating said means for moving said base member to move the latter toward said bottom position so as to maintain the top of the stack of paper on said base member at a relatively constant distance from said chute outlet end.

20. The apparatus as recited in claim 19 wherein said apparatus further includes a first switch which is activated when said base member is at said bottom position and a second switch which is activated when said base member is at said top position.

21. The apparatus as recited in claim 20 wherein said apparatus further includes means for applying a first signal to said device when said first switch is activated, said device being responsive to said first signal to terminate the supply of paper to said apparatus, said apparatus further including means for applying a second signal to said device when said second switch is activated to indicate to said device that said base member is at said top position.

22. A web folding apparatus, useful with a web dispensing device providing electrical pulses at a rate related to the rate of linear movement at which said web is dispensed therefrom, said apparatus comprising:

a base member;

web guide means including an entrance opening for guiding a web supplied through said entrance opening along a prescribed path extending substantially perpendicular to said base member, said web guide means including web diverter means mounted for rotational movement about an axis extending substantially perpendicular to said path; and control means for oscillating said web diverter means about said axis for alternately acting on opposite faces of said web to fold said web in alternate directions to form a stack on said base member, said control means including means responsive to a selected number of electrical pulses supplied thereto for progressively rotating said diverter means in one direction about said axis and responsive to a subsequent selected number of electrical pulses supplied thereto for progressively rotating said diverter means in an opposite direction about said axis.

23. The apparatus as recited in claim 22 further including means for moving said base member toward and away from said web diverter means for maintaining the top of the web stack at a substantially constant distance from said web diverter means.

24. The apparatus as recited in claim 23 wherein said apparatus further includes means for applying a signal to said web dispensing device when said base member moves a predetermined distance from said web diverter means.

* * * * *